United States Patent [19]

Alberny

[11] 4,009,749

[45] Mar. 1, 1977

[54] THIN-WALLED MOLD FOR THE CONTINUOUS CASTING OF MOLTEN METAL

[75] Inventor: Robert Alberny, Metz, France

[73] Assignee: Institut de Recherches de la Siderurgie Francaise (IRSID), Paris, France

[22] Filed: May 14, 1976

[21] Appl. No.: 686,522

[30] Foreign Application Priority Data

May 16, 1975 France ..... 75.15299

[52] U.S. Cl. ..... 164/147; 164/283 M; 164/348; 249/80; 249/135

[51] Int. Cl.[2] ..... B22D 11/04

[58] Field of Search ..... 164/283 M, 348, 283 R, 164/49, 147, 82; 249/79, 80, 135

[56] References Cited

UNITED STATES PATENTS

| | | | |
|---|---|---|---|
| 3,542,119 | 11/1970 | Wertli | 164/283 M |
| 3,605,870 | 9/1971 | Kroll et al. | 164/283 M |
| 3,662,814 | 5/1972 | Kipp et al. | 164/283 M |
| 3,667,534 | 6/1972 | Kanokogi et al. | 164/283 M X |
| 3,709,286 | 1/1973 | Bower, Jr. | 164/283 M |
| 3,730,257 | 5/1973 | Haussner | 164/283 M |
| 3,763,920 | 10/1973 | Auman et al. | 164/283 M X |
| 3,866,664 | 2/1975 | Auman et al. | 164/283 M |

FOREIGN PATENTS OR APPLICATIONS

| | | | |
|---|---|---|---|
| 1,354,421 | 4/1963 | France | 164/283 M |
| 962,259 | 7/1964 | United Kingdom | 164/283 M |

*Primary Examiner*—Ronald J. Shore
*Attorney, Agent, or Firm*—Kurt Kelman

[57] ABSTRACT

A mold for continuously casting of billets comprises an inner copper mold and an outer steel envelope surrounding the mold. The outer envelope is affixed to the inner mold by threaded tie rods which are anchored to parallel longitudinally extending ribs on the exterior faces of the inner mold. These ribs define grooves therebetween and the interior faces of the envelope have parallel longitudinally extending ribs facing the grooves. The facing ribs and grooves define therebetween longitudinal channels for a cooling liquid for the mold.

10 Claims, 2 Drawing Figures

THIN-WALLED MOLD FOR THE CONTINUOUS CASTING OF MOLTEN METAL

Figure 1:
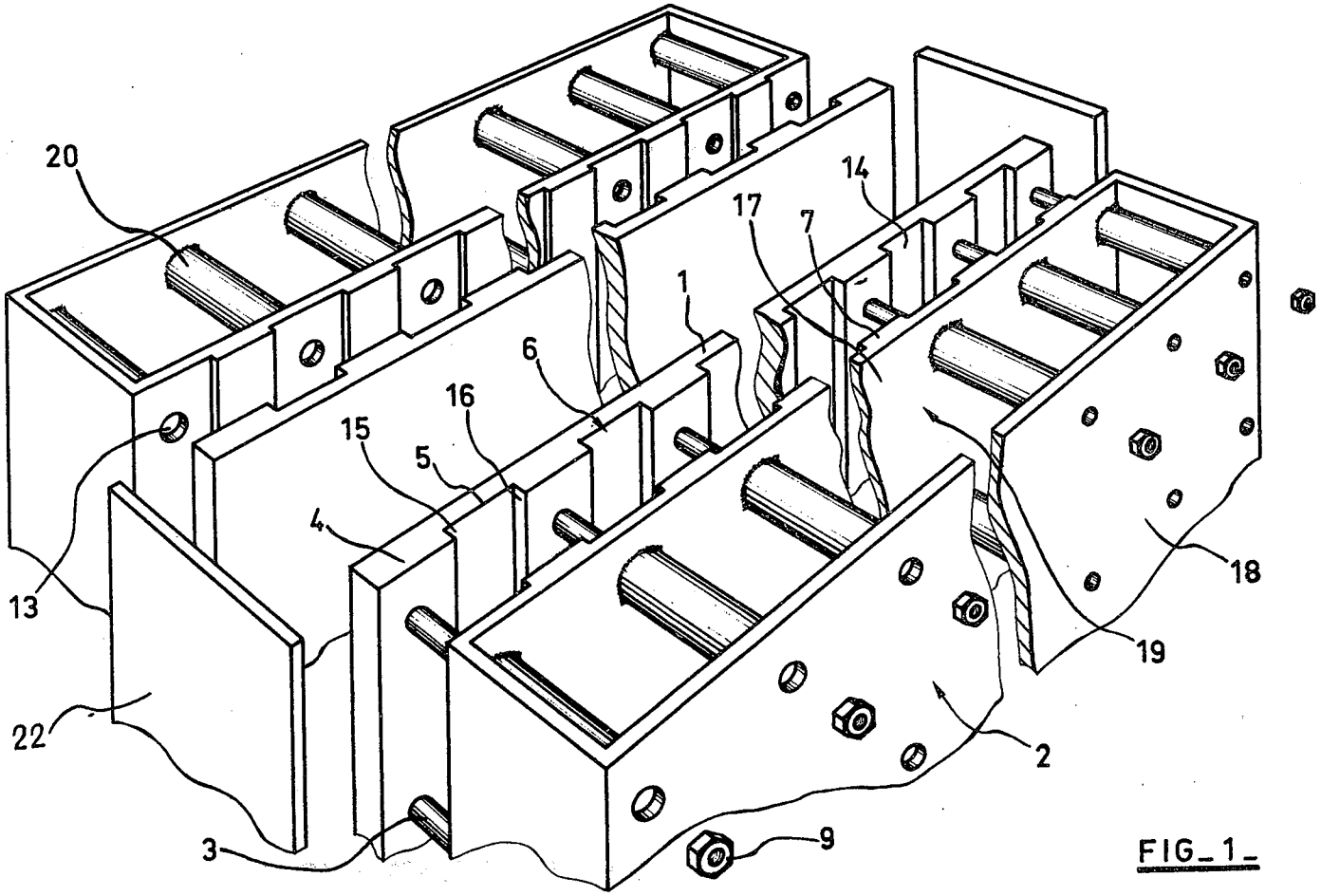

The present invention relates to improvements in thin-walled molds for the continuous casting of molten metal into metal strands, such as flat metal products of large section, for instance slabs or blooms.

A conventional mold for continuous metal casting may be considered as a permanently cooled mold which is open at both ends, molten metal being introduced at one end, flowing through the mold in contact with the cooled interior faces thereof, and leaving the mold through its other end as a partially solidified ingot. Generally, the mold is constituted by an inner mold element of copper or a copper alloy having interior faces defining therebetween a passage for the cast metal, and an outer envelope surrounding the inner mold element. The inner mold element assures good thermal conductivity while the outer envelope provides the required rigidity and imparts mechanical resistance to the mold assembly. A cooling liquid, usually water, circulates at high speed in longitudinal passages of channels between the inner mold element and the outer envelope.

In the case of casting metal products of relatively small section, the mechanical strength of the inner mold element can usually be maintained without the need for elaborate means for affixing the outer steel envelope to the inner mold element, even where the mold elements are thin, i.e. no more than about 20 mm. On the other hand, this is quite different in case metal products of large section are cast, such as slabs or blooms. Such mold assemblies pose considerable problems of mechanical strength. Increasing the width of the walls leads to a reduction of their bending strength, particularly in the central zone of the walls in contact with the large faces of the cast metal product. In conjunction with the ferrostatic pressure, the hydrostatic pressure of the cooling liquid and the strong thermal gradients in the walls, this may eventually lead to transverse deformations of the mold. To overcome these difficulties, which have caused such molds to have a short operating life, it has been proposed to increase the thickness of the inner mold element, which is generally constituted by an assembly of four copper plates, until the dimensions have assumed a suitable compromise between the necessary improvement in the thermal and mechanical characteristics of these mold element plates and a sufficient efficiency of the cooling sytem, on the one hand, and the required unitizing of the copper plates and the steel envelope by anchoring means which impart to the assembly the indispensible rigidity. For this purpose, it has been proposed to provide tap holes in the exterior faces of the inner mold element and to affix steel pins thereto which pass through bores in the outer envelope and carry nuts on their outer ends to maintain the envelope in place on the inner mold element. However, such thick-walled molds have certain disadvantages, including the need for the use of a large amount of copper, the poor distribution of stresses in the wall and a reduction in the cooling power compared to that of thin-walled molds. Furthermore, such thick-walled molds may not be used in all cases, such as where an electromagnetic inductor is used to impart movement to the cast metal in the mold, which is assuming growing importance in the industry. In this type of continuous metal casting mold, it is necessary to limit the absorption of the magnetic field as it traverses the copper plates and, to a lesser extent, the cooling liquid to a maximum extent. Thus, it is very desirable to reduce as much as possible the distance separating the inductor from the molten metal in the mold.

In view of the above, it is of considerable interest to have available thin-walled molds for continuously casting metal products of very elongated cross section such as slabs or blooms.

Molds of this type have been proposed with cooling liquid passages machined into the outer envelope and with a plurality of pins welded to longitudinal steel bands for fixing the envelope to the inner mold element, which bands are welded to grooves machined into the inner mold element. This arrangement involves great technical difficulties because the welding will weaken under the thermal stresses due to the considerable temperature gradient at the welding points and the mechanical stresses due principally to the strong hydrostatic pressures exerted by the rapidly circulating cooling liquid. Therefore, the problem of suitably holding the copper plates in contact with the passing molten metal has not been perfectly solved in this manner.

It is the primary object of this invention to provide a particularly advantageous solution to this problem and also to permit an electromagnetic inductor to be placed very close to the cast metal in such a thin-walled mold.

The above and other objects are accomplished in accordance with the invention with an inner mold element consisting of copper or a copper alloy, which has interior faces defining therebetween a passage for the cast metal and exterior faces having parallel longitudinally extending ribs defining grooves therebetween, and an outer envelope consisting of steel. The outer envelope is spaced from and surrounds the inner mold element, and has interior faces having parallel longitudinally extending ribs facing the grooves in the exterior faces of the inner mold element. The facing ribs and grooves define therebetween longitudinal channels for a cooling liquid for the mold, and means for affixing the envelope to the mold element are anchored to the ribs in the exterior faces of the inner mold element.

Figure 2:
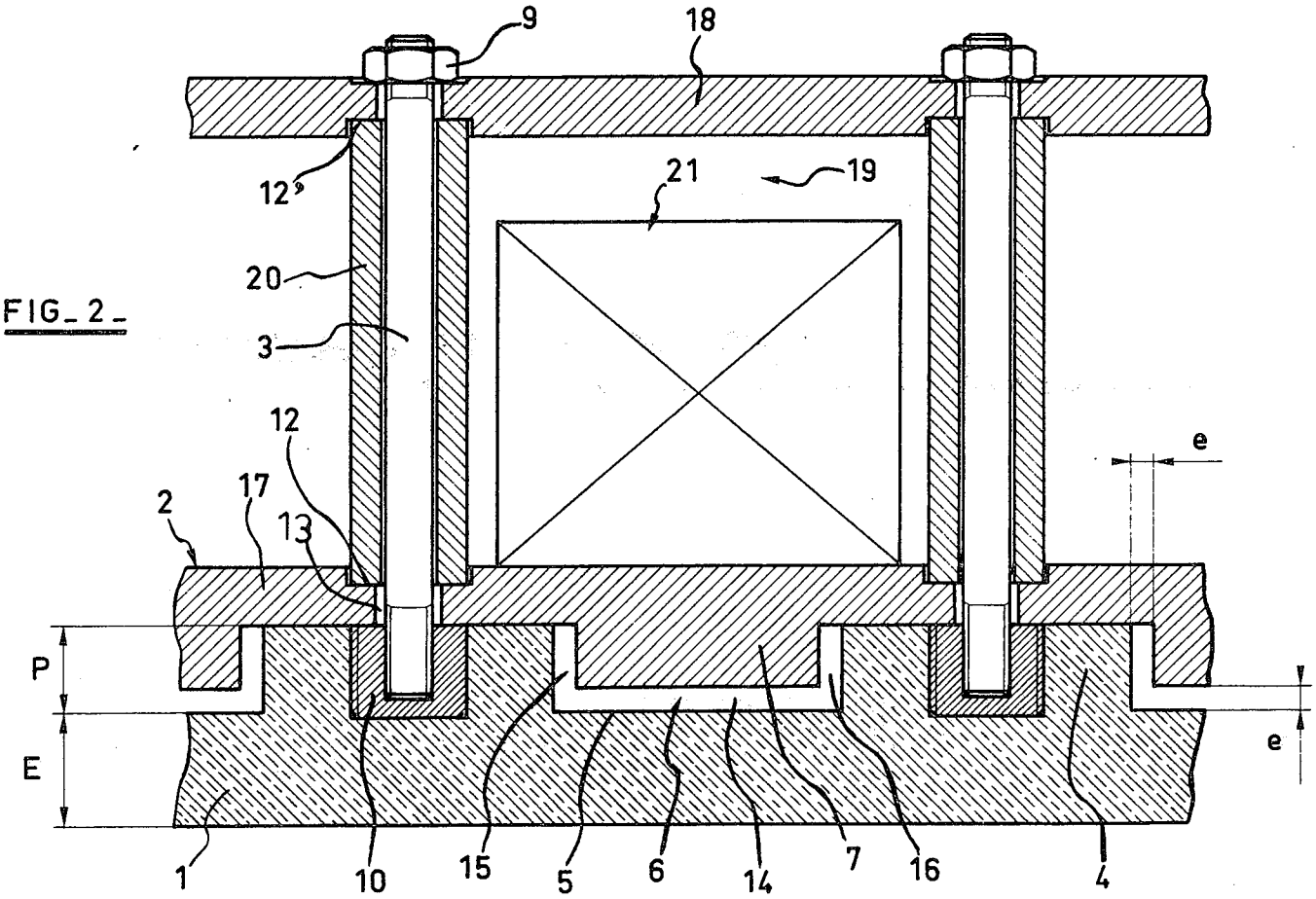

The above and other objects, advantages and features of the present invention will become more apparent from the following detailed description of a now preferred embodiment thereof, taken in conjunction with the accompanying drawing wherein FIG. 1 is an exploded and simplified persepective view of a mold and FIG. 2 is a horizontal section of one lateral part of a modified form of the mold.

Referring now to the drawing, the thin-walled mold for the continuous casting of molten metal, such as billets, is shown to comprise inner mold element 1 consisting of copper or a copper alloy. The interior faces of mold element 1 define therebetween a passage for the cast metal (not shown). Outer envelope or jacket 2 consisting of steel is spaced from and surrounds the inner mold element. The inner mold element and/or the jacket may be machined of a single piece or they may be constituted by assembled wall parts.

From the point of view of the invention, the only essential wall parts of the mold are those adjacent the large faces of the cast metal product, for which reason the end walls of outer envelope 2 adjacent the small faces of the cast metal product have not been shown so as not to encumber the drawing unnecessarily. For the same reason, end wall plates 22 of inner mold element 1 are shown only diagrammatically and without their specific structural dispositions. The objects of the invention will attained without these end wall plates having any specific characteristics, such as grooves or anchoring ribs similar to those to be described hereinafter in connection with the side walls adjacent the large faces of the cast metal product. It will be understood that, because of their narrow width, end wall plates 22 will not be subject to bending. Furthermore, electromagnetic inductors generally need not be present adjacent the small faces of the metal product so that no structural arrangements are required for this purpose in connection with these end wall plates. In other words, any conventional arrangement may be used for maintaining the end wall plates in position and for circulating cooling liquid in contact therewith.

According to the present invention, the exterior faces of inner mold element 1 adjacent the large faces of the cast metal products have parallel ribs 4 extending longitudinally in the direction of the passage of the cast metal. Ribs 4 define grooves 5 of substantially the same width therebetween. Outer envelope 2, or more precisely the parts of the outer envelope adjacent the large faces of the cast metal product, has interior faces having parallel, longitudinally extending ribs 7 facing grooves 5. The facing ribs and grooves define therebetween longitudinal channels 6 for a cooling liquid (not shown) for the mold, ribs 7 freely fitting into grooves 5 when the inner mold element and jacket are assembled, as shown in FIG. 2.

Threaded steel tie rods 3 affix envelope 2 to mold element 1, the tie rods being threadedly affixed to threaded holes machined into anchoring ribs 4 along the central axis of the ribs. The tie rods pass through bores 13 in envelope 2 and nuts 9 threadedly engage the outer ends of tie rods 3 and abut the exterior faces of the envelope.

The illustrated outer envelope, or more precisely the parts of the outer envelope adjacent the large faces of the cast metal product, is constituted by a hollow, double-walled cast piece walls 17 and 18 of which define interior chamber 19 for the cooling liquid. Interior chamber 19 is traversed by a plurality of bearing sleeves 20 through which the tie rods pass and which constitute support columns for the tie rods. If jacket 2 is made of a single piece, the mold may be readily assembled by slipping the jacket over the inner mold element, ribs 7 serving as guides gliding in grooves 5.

Mold element 1 is of copper or a copper alloy, such as a copper-silver or copper-chromium alloy, to assure good thermal conductivity and jacket 2 is of steel to impart good rigidity to the assembly.

FIG. 2 is an enlarge horizontal cross section of a portion of the mold, showing an embodiment wherein a plurality of steel plugs 10 are threadedly affixed in each anchoring rib 4. Each plug has a central threaded bore for anchoring a respective tie rod 3 to mold element 1. This arrangement has an advantage over screwing the steel tie rods directly into the copper anchoring ribs because it provides a large contact area of copper-to-steel and, therefore, better anchorage for the tie rods under the action of the high hydrostatic pressure of the cooling water rapidly circulating through chamber 6 between mold element 1 and jacket 2. Thickness E of inner mold element 1 is about 20 mm in the described embodiment. Generally, the wall thickness may vary between about 15 mm and 25 mm, a wall thickness of about 10 mm being sufficient to give element 1 sufficient rigidity.

While the outer envelopes 2 of FIGS. 1 and 2 are analogous, the special form shown in FIG. 2 does not consist of a single block but is constituted by two jacket walls 17 and 18 defining therebetween interior chamber 19 for the cooling liquid. The two jacket walls are interconnected by bearing sleeves 20 whose ends are seated recesses 12, 12' machined into the interior faces of walls 17 and 18.

It should be noted that the outer envelope need not be double-walled but that it could be constituted by a single wall 17. However, cooling chambers 19 adjacent the large faces of the cast metal serves the purpose of housing electromagnetic inductor 21 immersed in, and cooled by, the cooling liquid in the chamber. The inductor has a mobile magnetic field for imparting movement to the molten metal in inner element 1, inductor 21 being maintained in contact with the interior wall of envelope 2 for close proximity to the molten metal. In this case and to assure good magnetic permeability, jacket wall 17 will be made of an amagnetic material, such as stainless amagnetic steel.

I have made a number of experiments to ascertain the optimal configuration of the mold cooling system so as to assure good thermal and mechanical properties and a satisfactory extraction of calories permitting the rapid formation of an ingot skin resistant to tensile forces. The experiments were performed on a mold of 700 mm height, with a casting velocity of 2 meters/minute. The most satisfactory structure was obtained with U-shaped cooling channels 6, 15, 16, with the cooling channels 6 forming sheets 14 of cooling liquid parallel to the large face of the billet for optimum caloric extraction and lateral channels 15, 16 perpendicular thereto and in contact with anchoring ribs 4 for satisfactory cooling of the latter. This configuration is obtained with grooves 5 in the exterior faces of inner mold element 1 and facing ribs 7 in the interior faces of envelope 2 having a common plane of symmetry extending perpendicularly to the interior faces of the inner mold element. The grooves and the ribs in the illustrated embodiment are of rectangular cross section. However, the cooling channels may also be of a truly U-shaped, i.e. rounded, cross section or have the cross section of a V truncated at the base although these configurations will be slightly less effective.

The experiments have shown that channels 6, 15 and 16 are preferably of the same width. Similarly, grooves 5 and ribs 4 of the same width were found to be most advantageous, a width of about 50 cm being most effective although other widths may be selected. In this case, it is preferred to make the grooves wider than the ribs. As shown, ribs 7 have a height and a width slightly less than the depth and width of grooves 5 whereby each of the longitudinal channels for the cooling liquid is compressed of space 6 extending in a plane parallel to the interior faces of the inner mold element and designed to cool the cast metal in contact with the interior faces and two spaces 15, 16 extending laterally from, and perpendicularly to, space 6 to cool anchoring ribs 4 and tie rods 3 anchored therein.

My experiments have also resulted in precise numerical informations about optimal geometrical dimensions for the cooling channels. In this respect, the following considerations were taken into account: scalding phenomena must be avoided which would suddenly raise the temperature of the copper mold element beyond its annealing temperature. This would rapidly deteriorate the mold and could lead to grave casting incidents. Also, accumulation of vapor in the cooling channels could obstruct the proper water flow and unstable liquid flow could lead to unwanted vibrations of the mold. Furthermore, it may locally overheat the mold, thus leading to the scaling phenomena discussed hereinabove. Finally, it is desirable to avoid a water flow system producing local boiling since this will lead to scaling and thus interfere with the uninterrupted operation of the mold.

All of the above difficulties are avoided if the cooling liquid flow is stable and homogenous. This implies that the gradient of the pressure loss curve at any given point should be positive and as steep as possible. In effect, if this gradient is positive, stoppage of water flow due, for example, to an accumulation of vapor, will result in reducing the pressure loss and correspondingly increasing the water pressure at the entrance to this point, this reestablishing the desired flow the more efficiently and rapidly the steeper the loss curve gradient.

Under these conditions and taking into account the casting characteristics of billets, I have found the most advantageous cooling channels configurations to be those which, for a uniform cooling water flow not substantially exceeding 8 m 3 hour, permit attaining pressure losses per passage at least equal to $0.5\times10^5$ Pa to assure a stable flow.

Best results were obtained with thicknesses *e* of the longitudinal cooling channels between 2.5 mm and 4.5 mm for a depth P of grooves 5 varying between 10 mm and 25 mm. Preferably, thickness *e* varies between 3.5 and 4.5 mm, and the groove depth P does not exceed about 15 mm. The best groove depth is 12 mm and the best thickness is 3 mm. A uniform flow of 4 $m^3/h$ is very effective.

If a water sheet of 3 mm is technically not acceptable or undesirable for some reason, a groove thickness of 4 mm may be used, with a uniform water flow of about 6 $m^3/h$. In this case, for example, a 2-meter wide billet casting will require a mold whose large faces have about 20 longitudinal cooling channels of 50 mm width each and permitting the circulation of about 300 $m^3/h$ of water.

While the invention has been described in connection with certain now preferred embodiments, it will clearly be understood that many modifications and variations may occur to those skilled in the art, particularly after benefiting from the present teaching, without departing from the spirit and scope thereof as defined in the appended claims. More particularly, the cooling liquid may be fed independently to each lateral wall of the mold or from a single main to all walls.

What is claimed is:

1. A thin-walled mold for the continuous casting of molten metal, comprising 1. an inner mold element consisting of copper or a copper alloy, the inner mold element having
   a. interior faces defining therebetween a passage for the cast metal and
   b. exterior faces having parallel longitudinally extending ribs defining grooves therebetween;
2. an outer envelope consisting of steel, the outer envelope being spaced from and surrounding the inner mold element, the outer envelope having
   a. interior faces having parallel longitudinally extending ribs facing the grooves in the exterior faces of the inner mold element, the facing ribs and grooves defining therebetween longitudinal channels for a cooling liquid for the mold; and
3. for affixing the envelope to the mold element, the means being anchored to the ribs in the exterior faces of the inner mold element.

2. The thin-walled mold of claim 1, wherein the grooves in the exterior faces of the inner mold element and the facing ribs in the interior faces of the envelope have common planes of symmetry extending perpendicularly to the interior faces of the inner mold element.

3. The thin-walled mold of claim 1, wherein the grooves in the exterior faces of the inner mold element and the ribs in the interior faces of the envelope are of rectangular transverse cross section.

4. The thin-walled mold of claim 1, wherein the ribs in the interior faces of the envelope have a height and a width slightly less than the depth and width of the grooves in the exterior faces of the inner mold element whereby each of the longitudinal channels for the cooling liquid is composed of a space extending in a plane parallel to the interior faces of the inner mold element and designed to cool the cast metal in contact with the interior faces and two spaces extending laterally from, and perpendicularly to, the said space to cool the means for affixing the envelope to the mold element and the anchoring ribs therefor.

5. The thin-walled mold of claim 1, wherein the difference between the width of the grooves in the exterior faces of the inner mold element and that of the facing ribs in the interior faces of the envelope is equal to twice the difference between the depth of the grooves and the height of the facing ribs whereby the longitudinal channels for the cooling liquid defined therebetween has a section of constant thickness.

6. The thin-walled mold of claim 5, wherein the thickness of the longitudinal channels is between 2.5 mm and 4.5 mm and the depth of the grooves is between 10 mm and 25 mm.

7. The thin-walled mold of claim 1, wherein the means for affixing the envelope to the mold element are constituted by threaded tie rods threadedly affixed to the anchoring ribs and passing through bores in the outer envelope, and nuts threadedly engaging the outer ends of the tie rods and abutting the exterior faces of the envelope.

8. The thin-walled mold of claim 1, further comprising a plurality of steel plugs threadedly affixed in each of the anchoring ribs, each steel plug having a central threaded bore for anchoring the affixing means thereto.

9. The thin-walled mold of claim 1, wherein the outer envelope is hollow and defines an interior chamber for the cooling liquid, and further comprising an electromagnetic inductor with a mobile magnetic field immersed in the interior chamber for imparting movement to the molten metal in the inner mold element.

10. The thin-walled mold of claim 9, wherein the electromagnetic inductor is maintained in contact with the interior wall of the envelope for close proximity to the molten metal.

* * * * *